US006749007B2

(12) United States Patent
Ehlers et al.

(10) Patent No.: US 6,749,007 B2
(45) Date of Patent: Jun. 15, 2004

(54) COMPACT COOLING SYSTEM WITH SIMILAR FLOW PATHS FOR MULTIPLE HEAT EXCHANGERS

(75) Inventors: Michael Ehlers, Nagold (DE); Wolfgang Knecht, Stuttgart (DE); Daniela Fischer, Zell u. A. (DE); Roland Strähle, Unterensingen (DE); Jörg Soldner, Ehningen (DE); Werner Zobel, Böblingen (DE)

(73) Assignee: Modine Manufacturing Company, Racine, WI (US)

( * ) Notice: Subject to any disclaimer, the term of this patent is extended or adjusted under 35 U.S.C. 154(b) by 63 days.

(21) Appl. No.: 09/912,096

(22) Filed: Jul. 24, 2001

(65) Prior Publication Data

US 2002/0023738 A1 Feb. 28, 2002

(30) Foreign Application Priority Data

Aug. 25, 2000 (DE) ..... 100 41 795
Aug. 25, 2000 (DE) ..... 100 41 794

(51) Int. Cl.[7] ..... F01P 11/04

(52) U.S. Cl. ..... 165/41; 165/51; 165/101; 165/125; 165/140; 165/144; 123/41.49

(58) Field of Search ..... 165/41, 125, 101, 165/140, 144, 51; 123/41.49

(56) References Cited

U.S. PATENT DOCUMENTS

| | | | | |
|---|---|---|---|---|
| 1,366,900 | A | * | 2/1921 | Benson |
| 1,406,256 | A | * | 2/1922 | Bretagne |
| 1,423,662 | A | * | 7/1922 | Hewitt |
| 1,872,785 | A | * | 8/1932 | Modine |
| 2,095,058 | A | * | 10/1937 | Cross |
| 2,115,660 | A | * | 4/1938 | Yingling |
| 2,162,148 | A | * | 6/1939 | Wilson et al. ..... 165/101 |
| 3,205,939 | A | * | 9/1965 | Huet |
| 3,921,603 | A | * | 11/1975 | Bentz et al. |
| 3,978,919 | A | * | 9/1976 | Fachbach et al. |
| 4,038,970 | A | * | 8/1977 | D'Ascoli et al. ..... 165/144 |
| 4,062,401 | A | * | 12/1977 | Rudny et al. ..... 165/140 |
| 4,665,975 | A | * | 5/1987 | Johnston |
| 4,757,858 | A | * | 7/1988 | Miller et al. ..... 165/41 |
| 5,755,189 | A | | 5/1998 | Godeau et al. ..... 123/41.01 |
| 6,164,909 | A | * | 12/2000 | Ehlers et al. ..... 165/41 |

FOREIGN PATENT DOCUMENTS

| | | | |
|---|---|---|---|
| DE | 2921607 | | 11/1980 |
| DE | 4118463 | | 12/1991 |
| DE | 4220672 | * | 1/1993 |
| DE | 4205234 | | 8/1993 |
| DE | 4212070 | | 10/1993 |
| DE | 29504867 | | 8/1996 |
| DE | 19527050 | | 1/1997 |
| DE | 19724728 | | 2/1999 |
| DE | 19950753 | | 4/2001 |
| EP | 0222636 | | 3/1989 |
| EP | 0916819 | * | 5/1999 |
| GB | 2011606 | * | 7/1979 |
| JP | 4-62392 | * | 2/1992 |
| JP | 4-81381 | * | 3/1992 |

* cited by examiner

*Primary Examiner*—John K. Ford
(74) *Attorney, Agent, or Firm*—Wood, Phillips, Katz, Clark & Mortimer

(57) ABSTRACT

A compact cooling system including a radial fan directing air flow outwardly and a plurality of heat exchangers disposed around the radial fan. Each heat exchanger has a plurality of tubes extending between an inlet header and an outlet header, with the headers extending generally in the same direction as the fan axis. A system inlet is connected to the inlet headers and a system outlet is connected to the outlet headers, whereby the length of the connection between each heat exchanger and the system outlet and system inlet is generally the same for each heat exchanger.

10 Claims, 7 Drawing Sheets

COMPACT COOLING SYSTEM WITH SIMILAR FLOW PATHS FOR MULTIPLE HEAT EXCHANGERS

BACKGROUND OF THE INVENTION

The invention relates to compact cooling systems, and more particularly to a compact cooling system for vehicles having two heat exchangers with collecting tanks for cooling of different fluids.

A compact cooling system typically includes a number of heat exchangers (e.g. radiators), for cooling engine coolant for a vehicle engine. Rather than use one large radiator, a plurality of smaller radiators is used to reduce the space required to package the cooling system. These radiators, often together with at least one other heat exchanger, are located radially outwardly of a radial fan in a box-like configuration.

The use of multiple radiators will typically require that the radiators be connected in parallel rather than in series, since a series arrangement of the radiators would require greater pressure than is desired to ensure that the coolant circulate through all of the radiators (or put another way, will result in an undesirably high pressure drop from the system inlet to the system outlet).

Of course, a parallel arrangement of the heat exchangers introduces the additional problem of properly splitting the engine coolant flow among the plurality of smaller radiators, so that each may operate at maximum efficiency (i.e., without one radiator receiving more coolant than it should and another receiving less than it should). Where the radiators are approximately equal in size and coolant capacity, it is desirable to have approximately equal coolant flow through and heat transfer for each radiator.

The present invention is directed toward overcoming one or more of the problems set forth above.

SUMMARY OF THE INVENTION

A compact cooling system is provided including a radial fan directing air flow radially outwardly away from the fan axis and a plurality of heat exchangers disposed around the radial fan. Each heat exchanger has a plurality of tubes extending between an inlet header and an outlet header, with the headers extending generally in the same direction as the fan axis. A system inlet is connected to the inlet headers and a system outlet is connected to the outlet headers, such that the length of the flow path from the system inlet to the system outlet is generally the same for each heat exchanger.

In one form of the invention, adjacent headers define a corresponding corner of the compact cooling system, and the system inlet is adjacent one corner of one of the system front and system back, and the system inlet is adjacent another corner of the other of the system front and system back, which corners are opposite each other.

In another form of the invention, feed lines connecting the system inlet and system outlet to the inlet headers and outlet headers have substantially the same cross section with substantially rectangular cross sections defining substantially flat outer faces.

In still another form of the invention, there are two heat exchangers, with the system inlet including a short connection to the inlet header of one of the two heat exchangers and a long connection to the inlet header of the other of the two heat exchangers, and with the system outlet including a long connection to the outlet header of the one of the two heat exchangers and a short connection to the outlet header of the other of the two heat exchangers. In this form, the two heat exchangers may be disposed with the outlet header of one of the two heat exchangers adjacent the inlet header of the other of the two heat exchangers to define a corner of the compact cooling system, where one of the system inlet and the system outlet is adjacent the corner and the other of the system inlet and the system outlet is adjacent one of the inlet header of the one of the two heat exchangers and the outlet header of the other of the two heat exchangers. In this form, the two heat exchangers may alternatively be disposed on opposite sides of the compact cooling system, with the system inlet disposed adjacent the inlet header of one of the two heat exchangers and the system outlet disposed adjacent the outlet header of the other of the two heat exchangers.

In yet another form, a substantially rectangular box frame is provided with the system inlet is disposed adjacent one corner of the box frame at one of the front and back and the system outlet disposed adjacent another corner of the box frame at the other of the front and back.

In still another form, three heat exchangers define three of four sides of a box frame, with the system inlet and system outlet being adjacent corners diagonally opposite one another.

In yet other forms, the heat exchangers are substantially identical size, and the compact cooling system inlet receives coolant from a vehicle and discharges coolant to a vehicle from the system outlet.

DETAILED DESCRIPTION OF THE INVENTION

Figure 1:
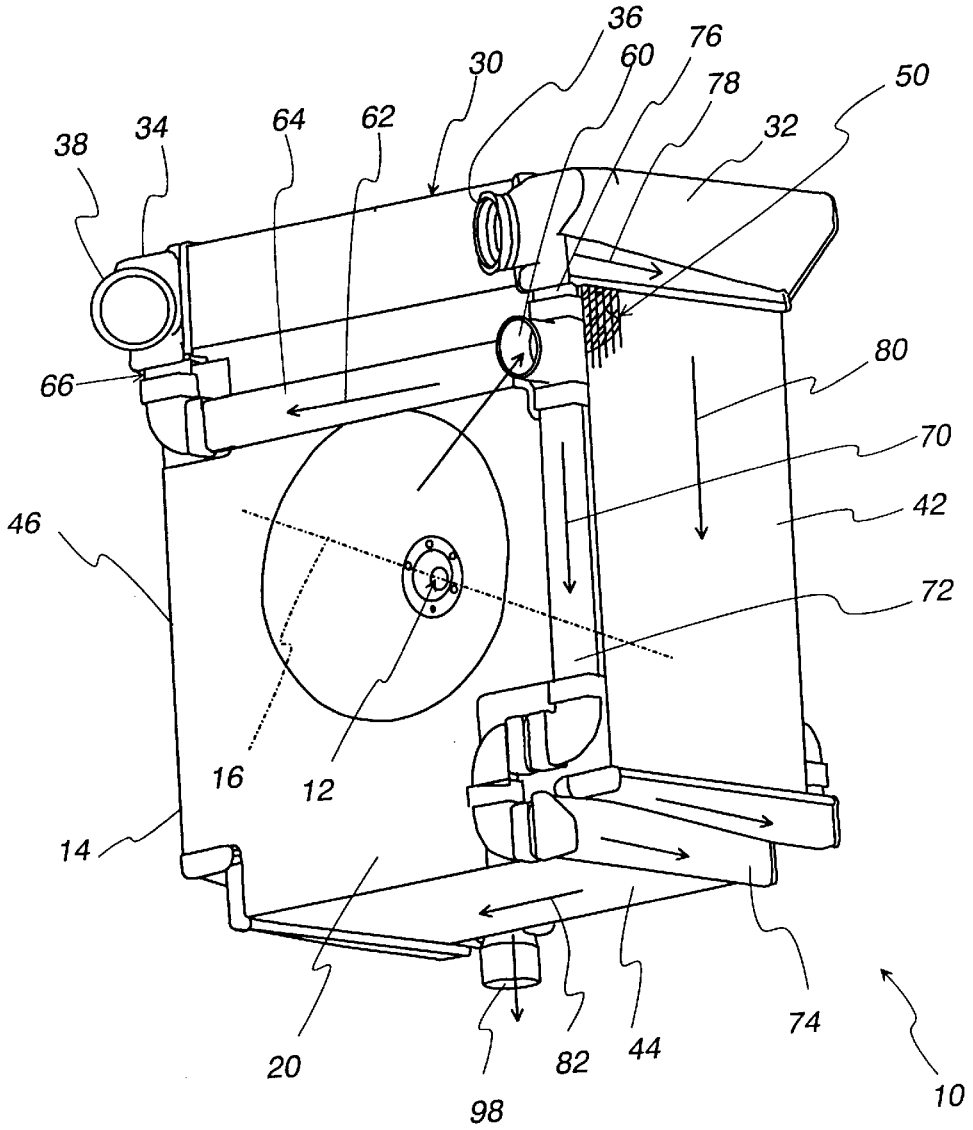
FIG. 1 is a rear perspective view of a compact cooling system made in accordance with the present invention.
Figure 2:
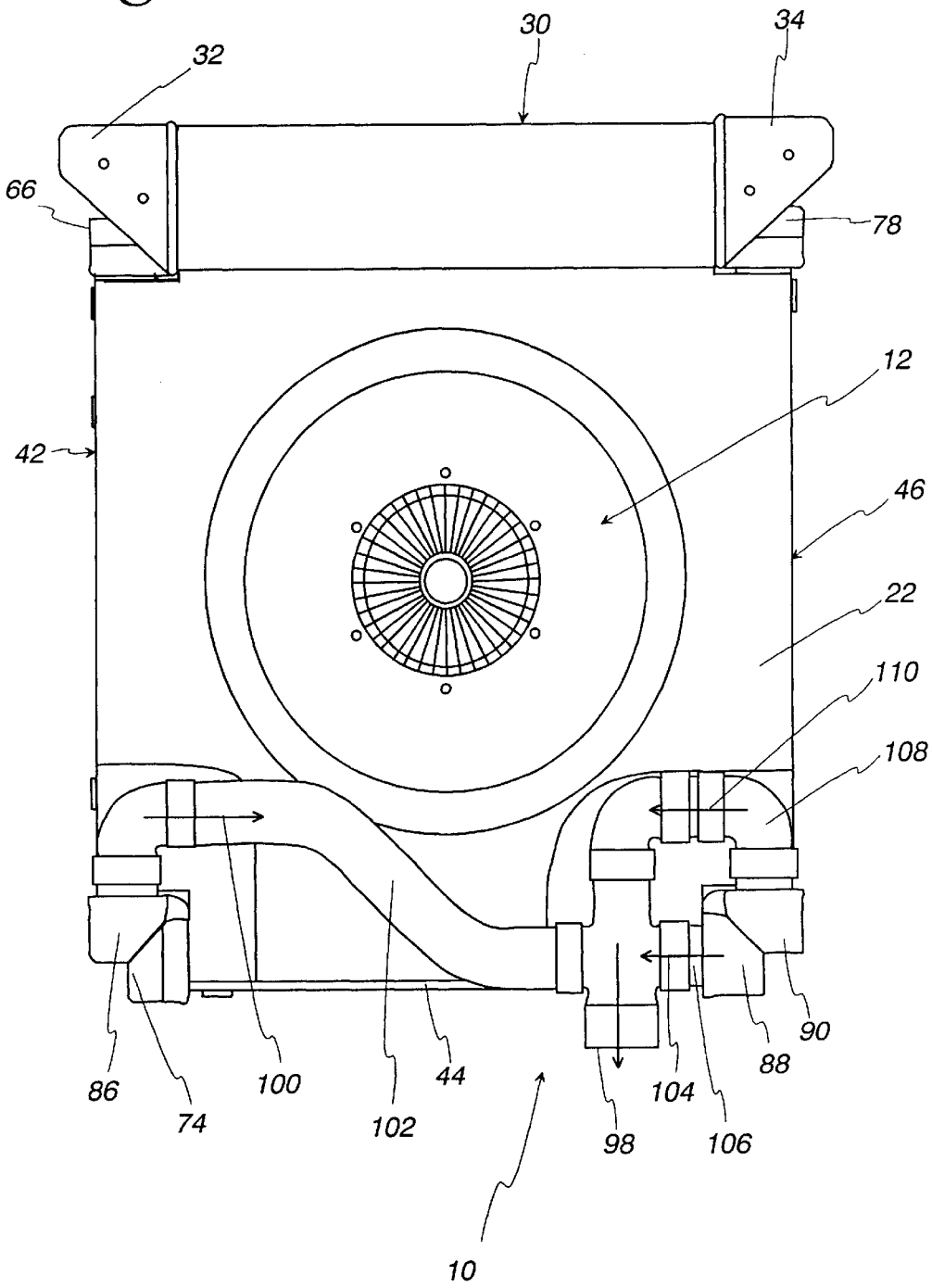
FIG. 2 is a front elevation view of the compact cooling system shown in FIG. 1.

One embodiment of a compact cooling system 10 incorporating the present invention is shown in FIGS. 1–2.

The compact cooling system 10 includes a radial fan 12 surrounded by a frame, generally designated 14, as described hereafter. The fan 12 rotates about an axis 16 to direct air to flow radially out and away from the axis 16 (and therefore through the heat exchangers arranged on the sides of the frame 14 as described hereafter). The compact cooling system 10 also includes a back or rear wall 20 (FIG. 1) and a front wall 22 (FIG. 2).

The frame 14 is in the general shape of a rectangular box which, in the FIGS. 1–2 embodiment, includes an upper heat exchanger 30 across the top side which operates independently. Specifically, the upper heat exchanger 30 includes a pair of headers 32, 34, one with an inlet 36 and one with an outlet 38. The upper heat exchanger 30 may be, for example, a conventional charge air cooler for cooling turbocharged or supercharged engine combustion air. Though not shown in the Figures, the upper heat exchanger 30 commonly may include a plurality of suitable tubes extending between the headers 32, 34, with suitable fins extending between the tubes (e.g., serpentine fins or plate fins), whereby the air flow in the upward direction caused by the fan 12 passes over the fins and tubes to cool them and thereby cool the coolant passing through the tubes such as is well known in the art. Such cooling could be one or two phase, that is, a hot fluid (liquid or gas) in the tubes could be cooled (one phase) or a gas such as a refrigerant could be condensed (two phase). It should also be understood that heat transfer in the opposite direction could occur within the scope of the invention (i.e., a hot gas could be passed over the fins and tubes which convey a cool fluid). Most commonly, however, the compact cooling system 10 may be used with vehicles in which the ambient air is used to cool engine fluids.

In the FIGS. 1–2 embodiment, the other three sides of the frame 14 comprise three separate heat exchangers 42, 44, 46, each of which may be of generally a similar, generally identical configuration as described for the upper heat exchanger 30 (i.e., with a pair of headers, one with an inlet and the other with an outlet, with tubes extending between the headers and fins between the tubes, such as partially shown at 50 in FIG. 1). (It should also be understood, however, that within the broad scope of the invention it would be possible to use the present invention with multipass heat exchangers which, as is understood in the art, have the inlet and outlet in the same headers where there are even numbers of passes.) These three heat exchangers 42, 44, 46 are, in the disclosed embodiment, substantially the same size with substantially the same tube sizes and numbers, and therefore to maximize the cooling capacity of the compact cooling system 10 it is desirable to maintain a substantially even coolant flow through each. This is accomplished as described hereafter.

Specifically, there is a single coolant inlet 60 on the rear of the compact cooling system 10. Coolant from whatever the compact cooling system 10 is used with (e.g., a vehicle engine) enters through the inlet 60 and from there is distributed to the heat exchangers 42, 44, 46 as follows:

1. Coolant passes (in the direction of arrow 62) through a relatively long horizontal feed line 64 connected to the inlet header 66 of one of the lateral or side heat exchangers 46.
2. Coolant passes (in the direction of arrow 70) through a relatively long vertical feed line 72 connected to the inlet header 74 of the bottom heat exchanger 44.
3. Coolant passes through a short feed line 76 to the inlet header 78 at the top of the other lateral heat exchangers 42.

In each of the inlet headers 66, 74, 78, the coolant is distributed such as is known to the previously described tubes and then passes through the tubes for cooling such as is known (in the direction of arrows 80, 82 in heat exchangers 42, 44 as shown in FIG. 1). The coolant exits the tubes into the outlet headers 86, 88, 90, all of which are located at the bottom of the compact cooling system 10 (the outlet headers 86, 90 are located at the bottom of the lateral heat exchangers 42, 46 and the outlet header 88 of the bottom heat exchanger 44 is at the end opposite its inlet header 74).

Each of the outlet headers 86, 88, 90 includes an outlet 92, 94, 96 from which the cooled coolant exits and from which it is collected at a single coolant outlet 98 as follows:

1. Coolant passes from the outlet header 86 of heat exchanger 42 (in the direction of arrow 100) through a relatively long generally horizontal feed line 102 connected to coolant outlet 98.
2. Coolant passes from the outlet header 88 of heat exchanger 44 (in the direction of arrow 104) through a very short feed line 106 connected to the coolant outlet 98.
3. Coolant passes from the outlet header 90 of heat exchanger 46 through another short feed line 108 (in the direction of arrow 110) connected to the coolant outlet 98.

The various feed lines may be rectangular in cross section to provide a relatively flat outer surface and thereby allow the outer faces of the compact cooling system 10 to be compact with minimal bulges. Further, the feed lines may also be of substantially similar size to provide similar flow resistance. The connection of the feed lines to the headers may be of any suitable configuration.

It should now be appreciated that the radial air flow caused by the fan 12 will cause air to pass through all four heat exchangers 30, 42, 44, 46 for advantageous cooling with all four. It should also be appreciated that the frame 14 can be advantageously manufactured using the four heat exchangers 30, 42, 44, 46 on all four sides. Further, as best seen in FIG. 2, the headers of the heat exchangers may be arranged snugly against one another to prevent air flow therebetween, thereby ensuring that maximum air flow generated by the fan 12 may occur where it is desired, through the tubes and fins of the heat exchangers.

Moreover, in accordance with the present invention, it should also be recognized that of the three heat exchangers 42, 44, 46 which operate in parallel with a single inlet 60 and a single outlet 98 will all have relatively identical flow paths for the coolant between the inlet 60 and the outlet 98. That is, the heat exchangers themselves provide substantially the same path (e.g., with similar headers and similar tubes). Further, the flow outside the heat exchangers is also substantially the same with flow through a relatively long and relatively short feed line:

1. For heat exchanger 42, coolant passes through a relatively short feed line 76 (between the inlet 60 and inlet header 78) and a relatively long feed line 102 (between the outlet header 86 and outlet 98).
2. For heat exchanger 44, coolant passes through a relatively long feed line 72 (between the inlet 60 and inlet header 74) and a relatively short feed line 106 (between the outlet header 88 and outlet 98).
3. For heat exchanger 46, coolant passes through a relatively long feed line 64 (between the inlet 60 and inlet header 66) and a relatively short feed line 108 (between the outlet header 90 and outlet 98).

In short, the flow of coolant will be essentially the same through each heat exchanger 42, 44, 46, with flow through similarly configured flow lines of similar length, with the result being that there will be a substantially identical flow resistance in the paths through the different heat exchangers 42, 44, 46 and therefore there will be a natural distribution of substantially identical mass flow of coolant through each to provide maximum efficiency among the three heat exchangers 42, 44, 46. Such an operation can be provided through the conjunction of similar feed lines arranged to extend in similar lengths for each heat exchanger. In practice, there will be small variations from identical mass flow dependant upon variations, such as the number of bends, in each flow path but these are tolerable so long as large discrepancies do not exist. As illustrated, the feed lines can be formed from various straight sections, bent sections, elbows, crosspieces, and the like suitably connected by sleeves.

It should also be understood, however, that variances could also be provided, with smaller feed lines, for example, being provided in slightly shorter lengths than relatively larger feed lines.

Figure 3:
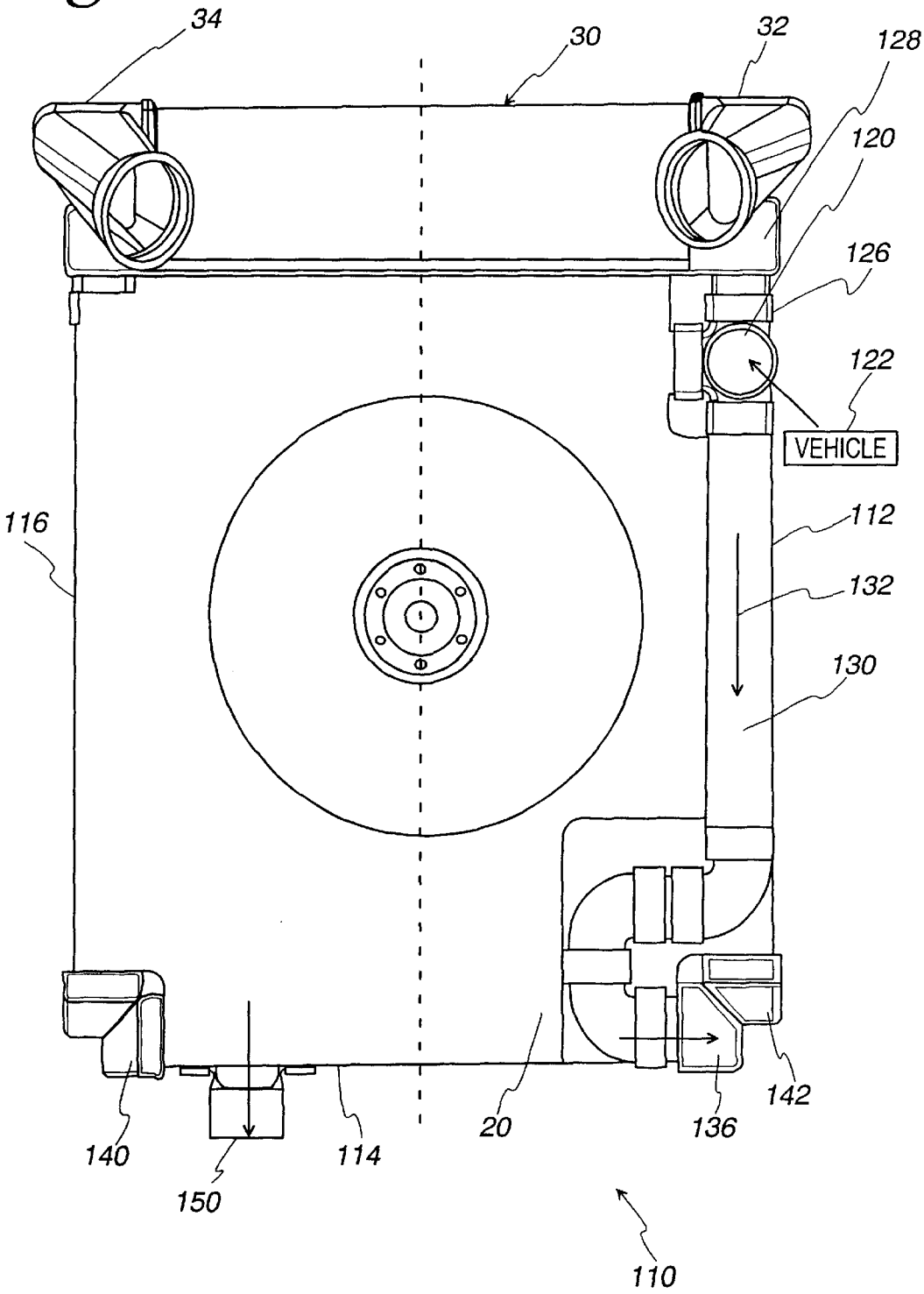
FIG. 3 is a rear elevation view of a second embodiment of a compact cooling system made in accordance with the present invention.
Figure 4:
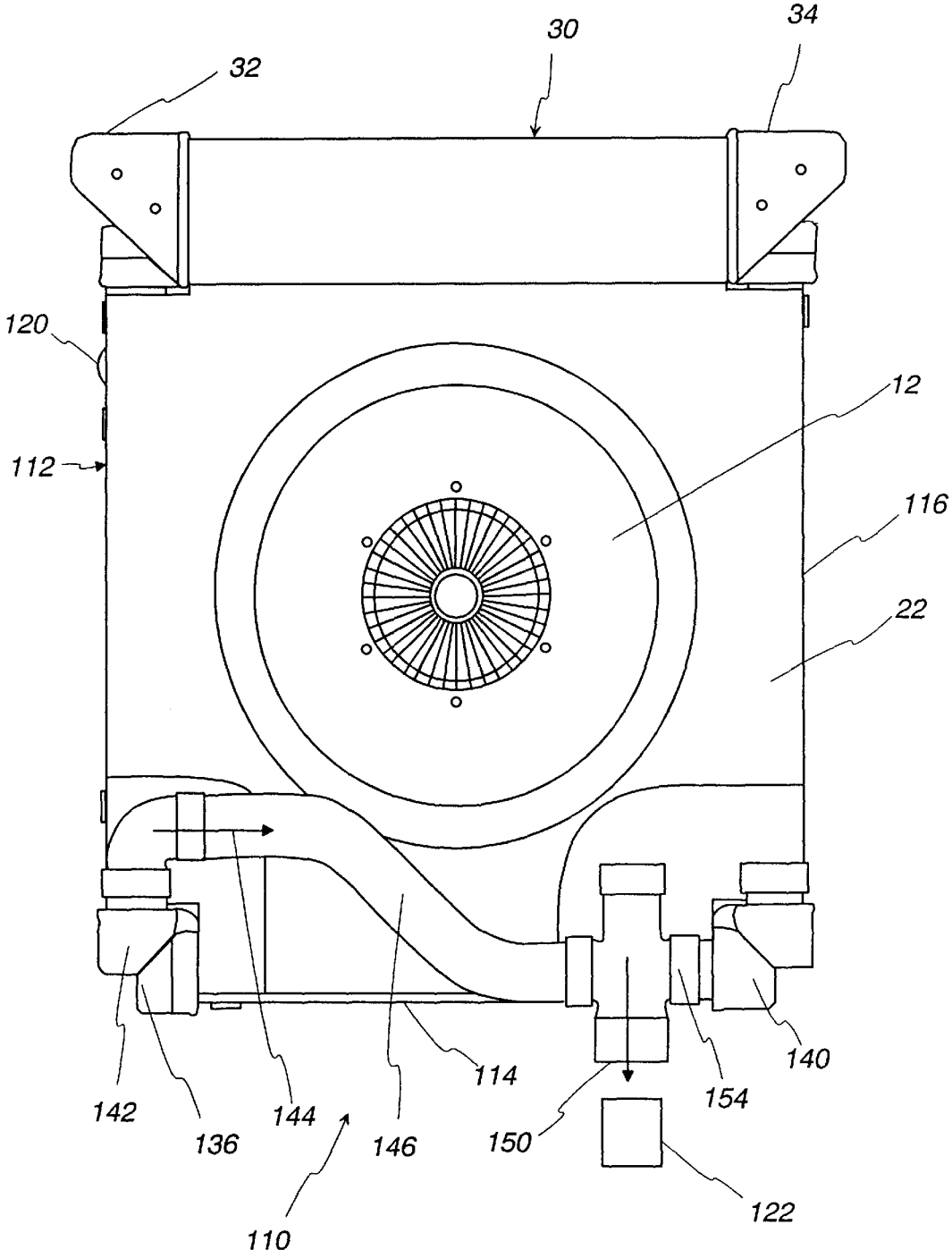
FIG. 4 is a front elevation view of the compact cooling system shown in FIG. 3.

A second alternative compact cooling system 110 is illustrated in FIGS. 3–4, in which two (rather than three as with the FIGS. 1–2 embodiment) heat exchangers 112, 114 are joined. (Similar components to those in the FIGS. 1–2 embodiment are given the same reference numerals as therein and not generally otherwise described here). The other side heat exchanger 116 may then be used for other purposes, for example, as an oil cooler or air conditioning condenser or gas cooler.

With this embodiment, the system inlet 120 (FIG. 3) receives coolant from the vehicle 122 (indicated diagrammatically in FIGS. 3–4) on the back side. Coolant from the inlet 120 is split, passing through a short feed line 126 to the inlet header 128 of heat exchanger 112, and through a longer feed line 130 (in the direction of arrow 132) to the inlet header 136 of the bottom heat exchanger 114. The split coolant passes through the tubes of both heat exchangers 112, 114, exiting into the outlet headers 140, 142, and through those headers to the front of the compact cooling system 110.

At the front as shown in FIG. 4, the coolant from heat exchanger 112 exits the outlet header 142 and passes in the direction of arrow 144 through relatively long feed line 146 to the outlet 150. Coolant from heat exchanger 114 exits its outlet header 140 and passes through the short feed line 154 to outlet 150 as well. Cooled coolant from the outlet 150 them passes back to the vehicle 122. It should thus be seen that, as with the first embodiment, the feed lines through which coolant for each heat exchanger 112, 114 pass are roughly the same length, again providing for preferred coolant distribution between the heat exchangers 112, 114 as previously described.

Figure 5:
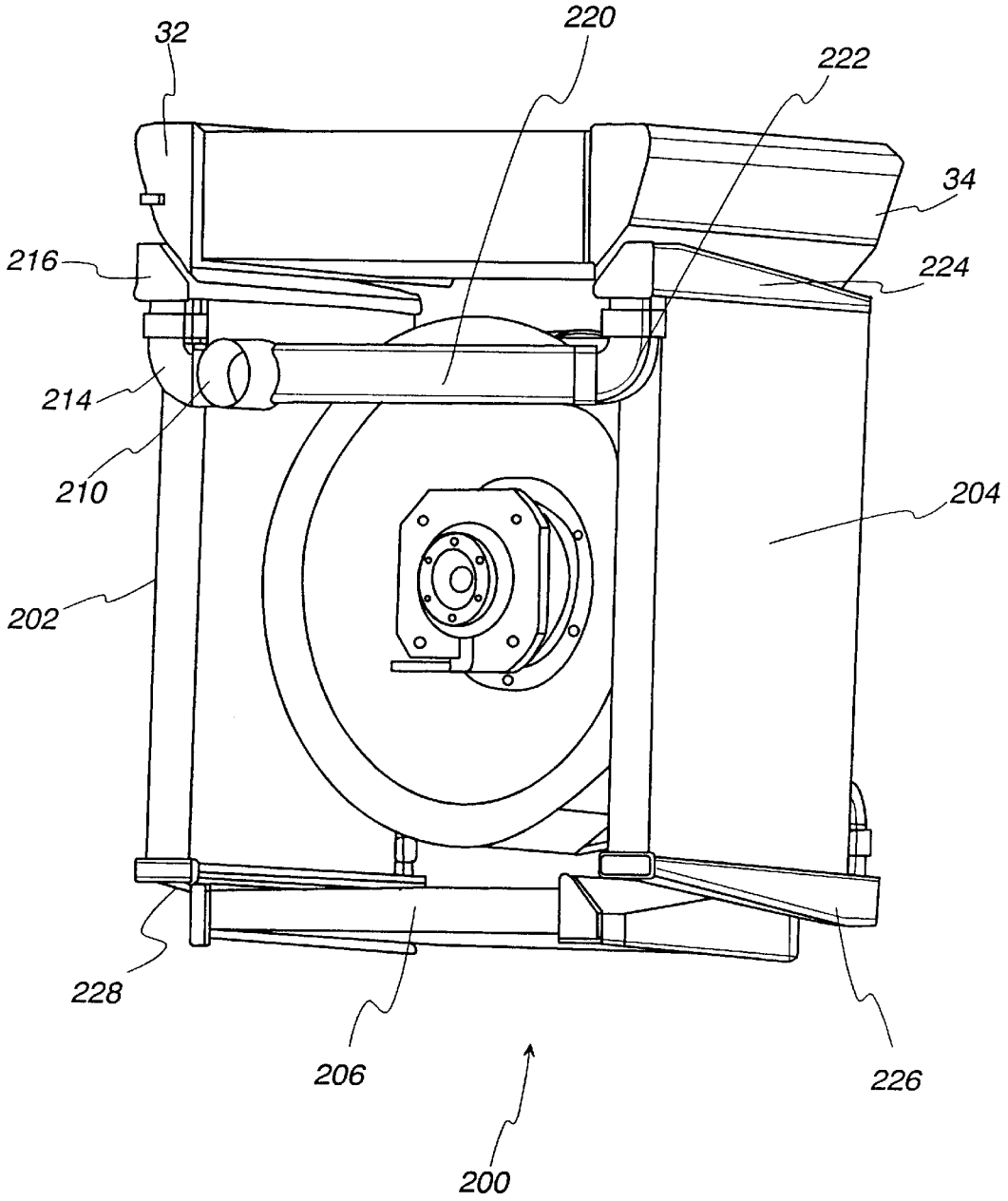
FIG. 5 is a rear perspective view of a third embodiment of a compact cooling system made in accordance with the present invention.
Figure 6:
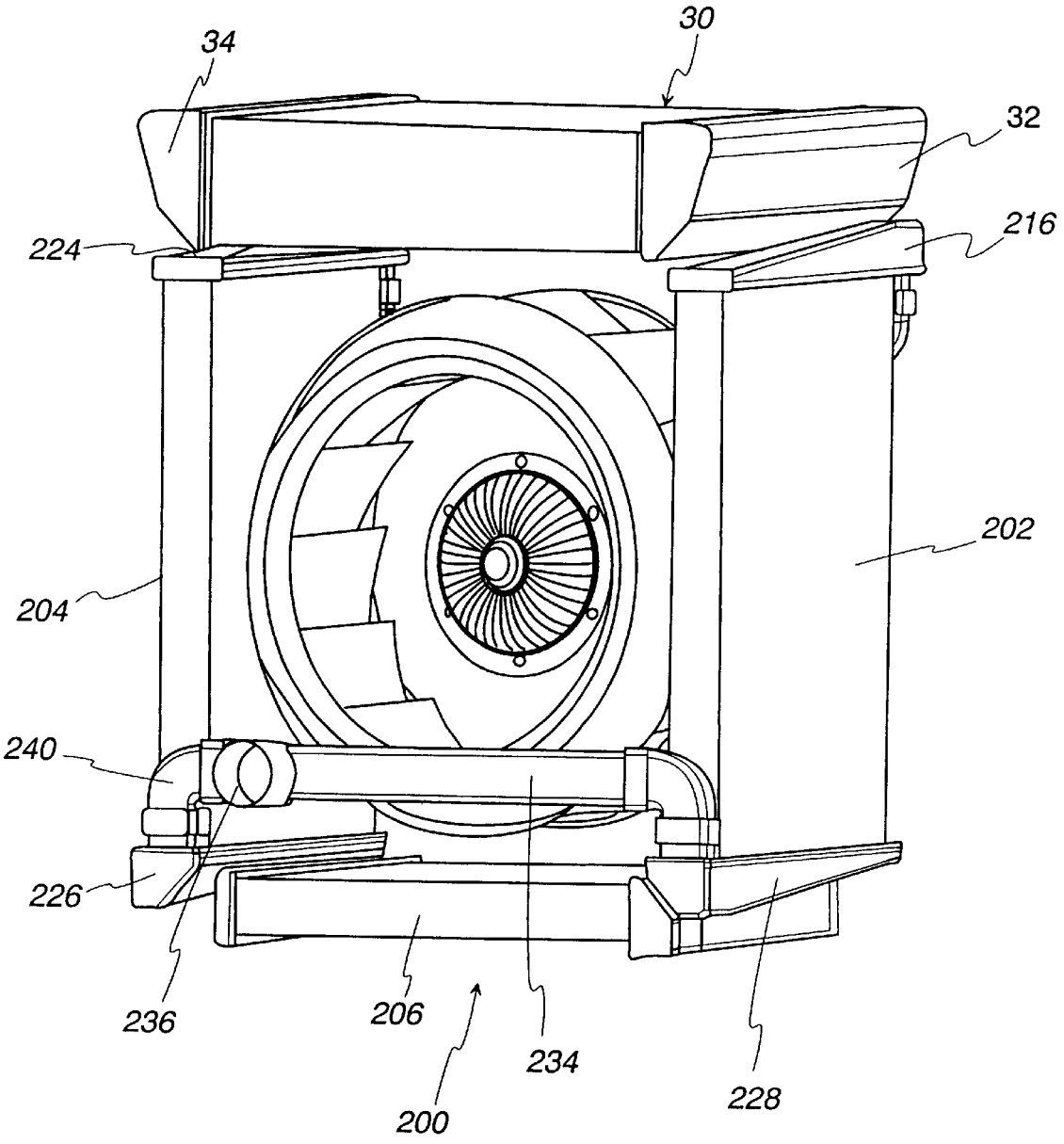
FIG. 6 is a front elevation view of the compact cooling system shown in FIG. 5.

A third alternative compact cooling system 200 is illustrated in FIGS. 5–6, in which two (rather than three as with the FIGS. 1–2 embodiment) substantially identical heat exchangers 202, 204 are joined, with these heat exchangers being on opposite sides of the compact cooling system 200. (Similar components to those in the previously described embodiments are given the same reference numerals as therein and not generally otherwise described here). In this case, the bottom heat exchanger 206 may again be used for other purposes, for example, as an oil cooler or condenser or gas cooler.

With this embodiment, the system inlet 210 (FIG. 5) receives coolant on the back side, and the coolant is split so that part passes through a short feed line 214 to the inlet header 216 of heat exchanger 202, and through a longer feed line 220 and an elbow 222 to the inlet header 224 of the other side heat exchanger 204. The split coolant passes through the tubes of both heat exchangers 202, 204, exiting into the outlet headers 226, 228, and through those headers to the front of the compact cooling system 200.

At the front as shown in FIG. 6, the coolant from heat exchanger 202 exits the outlet header 228 and passes through relatively long feed line 234 to the outlet 236. Coolant from the other side heat exchanger 204 exits its outlet header 226 and passes through the short feed line 240 to outlet 236 as well. It should thus be seen that, as with the previously described embodiments, the flow paths through which coolant for each heat exchanger 202, 204 pass have roughly the same flow resistance, again providing for preferred coolant distribution between the heat exchangers 202, 204 as previously described.

Figure 7:
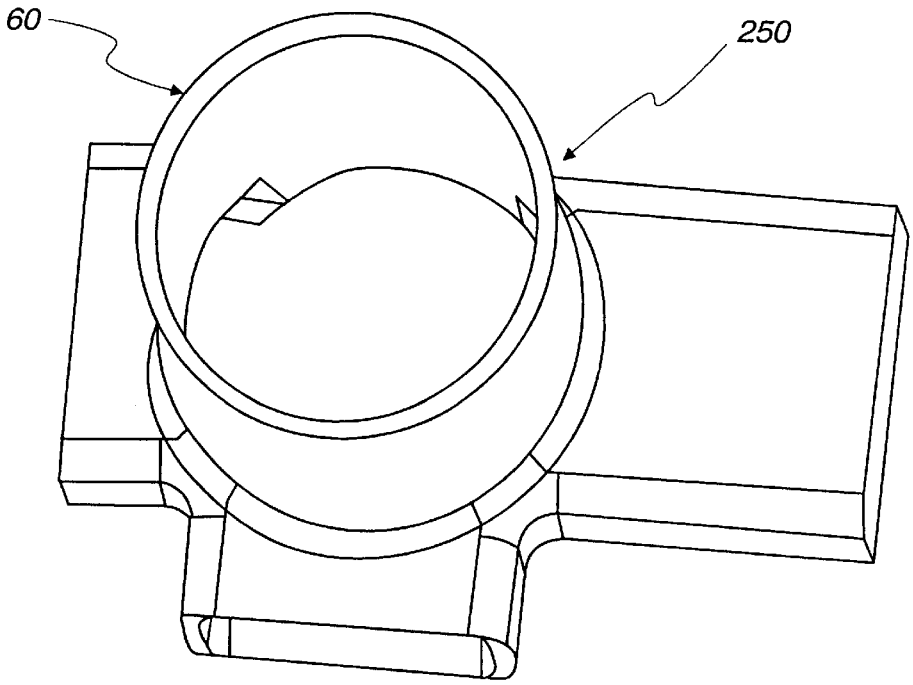
FIG. 7 is a perspective view of a feed cross piece of the compact cooling system shown in FIG. 1.
Figure 8:
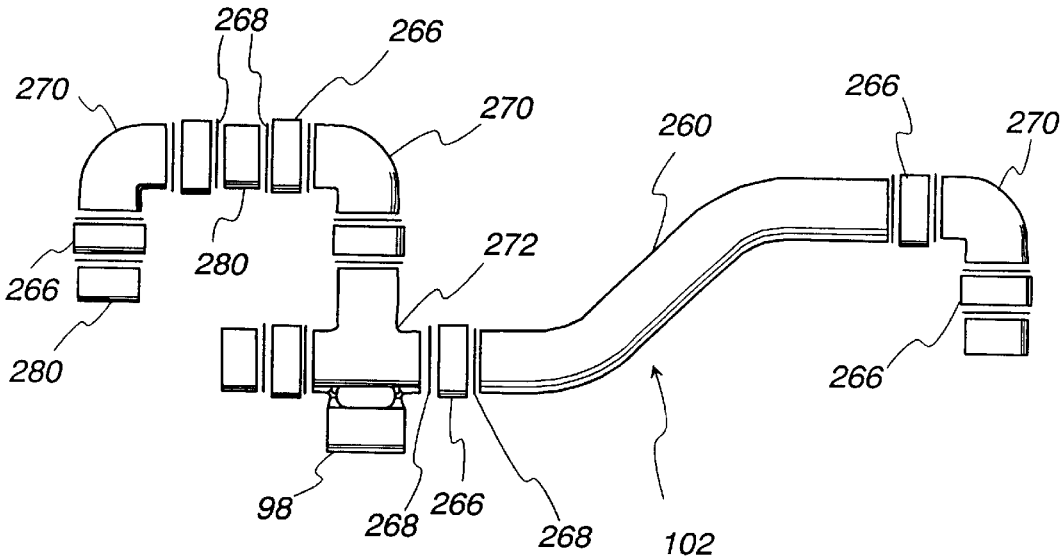
FIG. 8 is a sectional view across the discharge line of the compact cooling system shown in FIG. 1 as viewed from the rear of the compact cooling system.

FIGS. 7 and 8 illustrate components which may be used to arrange the feed lines of the various embodiments.

Specifically, FIG. 7 illustrates a T-piece 250 such as could be used at the inlet 60 of the FIGS. 1–2 embodiment. The T-piece 250 (and other feed line components) can be formed in any suitable manner dependent upon the coolant to be used (e.g., of materials capable of containing the coolant without unacceptable degradation resulting from corrosion and/or expected temperatures). For example, the feed line components could be formed by plastic injection molding. As previously noted and as illustrated in FIG. 7, the lines may be flat rather than round to allow them to be located on the face of the compact cooling system without projecting outwardly from the face (e.g., to maintain a generally rectangular box outer shape).

FIG. 8 illustrated in exploded view the multiple components which can be used to form the feed lines, in this case the outlet structure at the bottom front of the FIGS. 1–2 embodiment (shown specifically in FIG. 2). In this sample structure, the relatively long feed line 102 is configured from a long bent portion 260 secured at opposite ends by sleeves 266 and seals 268 to an elbow 270 and a cross piece 272 having the coolant outlet 98. Suitable shorter portions 280 can be used with such components so that the desired lengths of feed lines can be suitably connected to the various heat exchangers in a modular fashion such as described above.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A compact cooling system comprising:

a radial fan having an axis, said radial fan directing air flow outwardly away from said fan axis;

first and second heat exchangers disposed around said radial fan, each heat exchanger having a plurality of tubes extending between an inlet header and an outlet header, said headers extending generally in the same direction as said fan axis with said plurality of tubes spaced from a system front to a system back across said air flow, said two first and second heat exchangers being disposed with said outlet header the first heat exchanger adjacent said inlet header of the other of said two second heat exchanger to define a corner of said compact cooling system; and a system inlet connected to said inlet headers and a system outlet connected to said outlet headers, such that the length of the flow path from said system inlet to said system outlet is generally the same for each heat exchanger, wherein said system inlet includes a short connection to the inlet header of the first heat exchanger and a long connection to the inlet header of the second two heat exchanger, and said system outlet includes a long connection to the outlet header of said first heat exchanger and a short connection to the outlet header of the second exchanger.

2. The compact cooling system of claim 1, wherein feed lines connect said system inlet and system outlet to said inlet headers and outlet headers, said feed lines having substantially the same cross section.

3. The compact cooling system of claim 2, wherein said feed lines have substantially rectangular cross sections whereby said compact cooling system includes substantially flat outer faces.

4. The compact cooling system of claim 1, wherein:

said cooling system includes a substantially rectangular box frame extending from a front to a back and surrounding said radial fan;

said first and second heat exchangers each generally define one side of said box frame;

said system inlet is disposed adjacent one corner of said box frame at one of said front and back; and said system outlet is disposed adjacent another corner of said box frame at the other of said front and back.

5. The compact cooling system of claim 4, wherein said box frame includes four sides and said at least two heat exchangers define two of said four sides, further comprising a third heat exchanger generally defining a third side of said box frame four sides.

6. The compact cooling system of claim 5, wherein said another corner is diagonally opposite said one corner.

7. The compact cooling system of claim 5, wherein said first and second heat exchangers are disposed substantially header to header to define at least a portion of said frame surrounding said radial fan.

8. The compact cooling system of claim 1, wherein said heat exchangers are substantially the same size.

9. The compact cooling system of claim 1, wherein said compact cooling system inlet receives coolant from a vehicle and discharges coolant to a vehicle from said system outlet.

10. The compact cooling system of claim 1, wherein said fan axis lies substantially between said system outlet and said system inlet.

* * * * *